United States Patent [19]

Mäki-Rahkola et al.

[11] Patent Number: 5,054,263

[45] Date of Patent: Oct. 8, 1991

[54] METHOD AND APPARATUS FOR WRAPPING A PLASTIC FILM AROUND A LOAD

[75] Inventors: Jari Mäki-Rahkola, Kauhajoki; Juhani Könönen; Jorma Surakka, both of Hyvinkää, all of Finland

[73] Assignee: Insinööritoimisto Pesmel Oy, Kauhajoki, Finland

[21] Appl. No.: 538,392

[22] Filed: Jun. 14, 1990

[51] Int. Cl.[5] ..... B65B 11/04

[52] U.S. Cl. ..... 53/399; 53/441; 53/556; 53/587; 53/64

[58] Field of Search ..... 53/399, 441, 556, 587, 53/588, 64; 242/75.47

[56] References Cited

U.S. PATENT DOCUMENTS

| | | | |
|---|---|---|---|
| 3,257,086 | 6/1966 | Drenning | 242/75.47 |
| 3,281,634 | 10/1966 | Studer | 242/75.47 |
| 3,759,432 | 9/1973 | Hutzenlaub | 53/556 X |
| 4,077,179 | 3/1978 | Lancaster | 53/587 |
| 4,362,001 | 12/1982 | Cockerham | 53/556 X |
| 4,387,552 | 6/1983 | Lancaster | 53/556 |
| 4,458,467 | 7/1984 | Shulman | 53/399 |
| 4,503,658 | 3/1985 | Mouser et al. | 53/441 |
| 4,590,746 | 5/1986 | Humphrey | 53/556 |
| 4,844,371 | 7/1989 | Tahara | 242/75.47 |

FOREIGN PATENT DOCUMENTS

| | | | |
|---|---|---|---|
| 0144266 | 6/1985 | European Pat. Off. . | |
| 3140972 | 6/1982 | Fed. Rep. of Germany | 53/587 |
| 2617122 | 12/1988 | France . | |

*Primary Examiner*—John Sipos

*Attorney, Agent, or Firm*—John P. White

[57] ABSTRACT

The problem involved in wrapping a stretched plastic film around a load by rotating the load and the plastic film feed roll is often that the film will not adapt well enough to the shape of the load, will not form an elastically tensioned package, and will not necessarily be by its stretch ratio and thickness sufficiently uniform and suitable for the product in question. In the present invention, a method has been developed for wrapping a stretched plastic film around the circumference of a load by rotating the load and the plastic film feed roll each about its axis in order to unwind the stretchable plastic film from the feed roll and to wrap the stretched plastic film around the circumference of the load and by braking the plastic film in order to stretch it between the braking point and the wrapping point. The advantages of the invention are based on the fact the braking power which induces the stretching of the plastic film is regulated on the basis of the circumferential speed of the load. In this manner it is possible to achieve completely simultaneous stretching and wrapping, wherein the contact point between the load and the plastic film constitutes the downstream end of the film-stretching distance.

9 Claims, 1 Drawing Sheet

METHOD AND APPARATUS FOR WRAPPING A PLASTIC FILM AROUND A LOAD

BACKGROUND OF THE INVENTION

The present invention relates to a method for wrapping a stretched plastic film around the circumference of a load by rotating the load and the plastic film feed roll each about its axis in order to unwind the stretchable plastic film from the feed roll and to wrap the stretched plastic film around the circumference of the load, and by braking the plastic film in order to stretch it between the braking point and the wrapping point.

The invention also relates to an apparatus for wrapping a stretched plastic film around the circumference of a load, the apparatus having means for supporting the load and for rotating it about its axis, bearing means for mounting the feed roll for the stretchable plastic film, and means for braking, between the feed roll and the load, the stretchable plastic film unwinding from the feed roll and the stretched plastic film being wrapped around the load.

Plastic film is often strengthened by stretching. Thereby the macromolecules of the film become parallel and the secondary bonding forces between them increase, greatly strengthening the plastic film in its stretch direction. An important measurement quantity in this case is the film stretch ratio, by which is meant the ratio between the lengths of the film when stretched and when unstretched, or in an ongoing process the speed ratio between the respective film portions. The film stretch ratio is determined according to the use of the film, and it is dependent on the properties of the plastic material of the film and on the stretching conditions, such as the temperature. A film of a suitable material may in advantageous conditions stretch up to 300%, in which case, for example, the strength of a polyethylene film in its stretch direction may increase approximately three-fold. When the width of the plastic film during stretching is maintained substantially constant, it follows from such an extent of stretching that large quantities of film material are saved.

When a stretched wrapping film is needed, it is possible to select a pre-stretched film of a suitable plastic material. Such a film has, however, the disadvantage that it will not adapt to the shape of the load during the wrapping process, will not form an elastically tensioned package, and will not necessarily by its stretch ratio and thickness be suitable for the specific product or product component concerned.

The disadvantage of a plastic wrapping film stretched at a constant force on the wrapping site is that the constant force emphasizes any cross-sectional variations present in the original film. At the same time, great variations in the stretch ratio are produced in the film. This is due to the fact that the thinnest areas in the film stretch more readily under the effect of the constant force and are thereby thinned to a relatively greater extent than are the thicker areas. Furthermore, it has proven difficult in a such a method to maintain constant the stretching force; e.g. the braking force, and thus variations of even other kinds have been produced in the stretch ratio.

By the use of a plastic film stretched on the site at a constant stretch ratio, a wrapping film on average of a suitable stretch ratio and thickness is obtained. U.S. Pat. No. 4,302,920 discloses the accomplishing of a constant stretch ratio between the feed roll and the load being wrapped, by means of a roller pair synchronized at different rotation speeds. However, in the method according to this patent, in which the stretching distance is between the rollers of the said roller pair, it has not been possible during the wrapping to take into account the film winding speed variations caused by the shape of the load to be packaged. Efforts to solve the problem have been made in U.S. Pat. No. 4,503,658 in which the tension of the film between the roller subsequent to the stretching distance and the load to be packaged is maintained constant, in which case the tension variation caused in the film by the shape of the load cannot pass to the area of the stretching distance to disturb the operation of the rollers operating at a constant stretch ratio. The measuring based on film tension is, however, deficient, since the elasticity of the film causes in the measurement a delay with respect to the rapid increases and decreases in the tension of the film, in which case the tension variations that the film is subjected to may, however, disturb the stretching.

SUMMARY OF THE INVENTION

The object of the present invention is to provide a method and apparatus for winding a stretched plastic film around a load to be packaged, by stretching the film so that it will at a suitable stretch ratio and thickness surround the load to be packaged. It is a further object to provide a stretched film of as uniform a thickness as possible around the load. The invention also aims at a method and apparatus by means of which the wrapping of a plastic film around a load is carried out taking into account both variations in the outer shape of the load and the film elasticity and its variations; this will ensure that a film of the correct stretch ratio and thickness is produced which is uniformly tensioned around the load.

The method according to the invention is thus characterized in that the braking power inducing the stretching of the plastic film is regulated on the basis of the circumferential speed of the load. The apparatus according to the invention, on the other hand, is characterized in that it has means for measuring the circumferential speed of the load and braking means for regulating the braking power. The novelty in the invention is thus that the plastic film is stretched on the basis of the circumferential speed of the load being packaged, whereby the disadvantages mentioned above can be eliminated.

The circumferential speed can be measured by any suitable device for measuring circumferential speed, such as a roller rotating on the circumferential surface of the load. The circumferential speed is registered, and according to one embodiment it is processed electronically to control the desired film stretch ratio. According to another embodiment the means measuring the circumferential speed of the load, such as the said roller, is directly mechanically coupled to the stretching means.

The means rotating the load is preferably at the same time the downstream end of the film web stretching distance (as seen in the travel direction of the film). In this case the circumferential speed of the load must be such that the braking means at the upstream end of the film stretching distance is capable of maintaining the desired stretch ratio. The most practical solution is achieved when the means rotating the load and the means measuring its circumferential speed are one and the same rotating roller.

At the upstream end of the film stretching distance there is a means controllably braking the travel of the film. The regulation is on the basis of the circumferential speed of the load. According to one embodiment, the braking means is a separate pair of rollers forming a compression point between them, the roller pair being located between the feed roll and the load. The said regulated braking force is required in only one of the rollers of the roller pair, whereas the other roller produces the compressive force required for the braking.

Above, an embodiment of the invention has been described in which the braking power inducing the stretching of the film is regulated merely on the basis of the circumferential speed of the load being packaged. It is, however, advantageous to regulate the braking power on the basis of the circumferential speeds of both the load and the feed roll. This is carried out by connecting the measuring means both to the load and to the feed roll, by processing the measurement values, and by regulating on the basis of these values the circumferential speeds of the load and the feed roll so as to produce the desired stretch ratio.

The means measuring the circumferential speed of the load are thus preferably connected to the roller which supports the load and possibly rotates it. The means measuring the circumferential speed of the feed roll are preferably connected to the roller which is against the feed roll or to a separate braking roller pair, which is located at a point between the feed roll and the load. In the latter case one of the rollers of the roller pair is operationally connected to the roller which supports and possibly rotates the load, in such a manner that the said one roller rotates at a slower circumferential speed than the supporting roller.

The packaging-film stretching and wrapping systems described above are operated by using highly conventional control, drive and braking devices. The roller rotating the load may be motor-driven and the motor may be electronically controlled. The brake roller has preferably an eddy current brake which is mounted on the roller shaft and connected to the circuit which controls the rotation speed of the load. If the control circuit measures the angular speeds $w_2$ and $w_1$ of the separate drive roller and brake roller for the load, the stretch ratio $S_2:S_1$ obtained is $$\frac{S_2}{S_1} = \frac{v_2}{v_1} = \frac{w_2 \cdot R_2}{w_1 \cdot R_1} \quad (1)$$

where $R_2$ is the radius of the driver roller and $R_1$ is the radius of the brake roller.

According to another important embodiment of the invention, the brake roller and the separate drive roller for the load are mechanically coupled to each other at a predetermined or regulatable transmission ratio. Such a ratio can be achieved, for example, with the aid of a gear system or belt transmission. The brake roller may be either a roller which brakes the plastic film feed roll, or it may constitute a separate roller pair at a point between the feed roll and the load to be wrapped, but so that the load constitutes the downstream end of the stretching distance. When belt transmission is used, the following stretch ratio is obtained for the film:

$$\frac{S_2}{S_1} = \frac{v_2}{v_1} = \frac{R_2 \cdot r_1}{R_1 \cdot r_2} \quad (2)$$

where $R_2$ and $r_2$ are the radii of the load drive roller and the belt pulley belonging to it, respectively. The belt transmission may be, for example, such that the transmission ratio can be regulated by changing the width of the V-belt groove of the belt pulley.

It is required of the load to be packaged that its circumferential speed can in practice be measured, for example by using a roller following the circumference when it rotates about its axis. From this it also follows that the load to be packaged is preferably cylindrical in cross section, i.e. its circumference is, for example a circle, an ellipse, a polygon with rounded angles, or the like.

BRIEF DESCRIPTION OF THE DRAWINGS

The invention is described below in greater detail with reference to the accompanying drawings, in which.

DESCRIPTION OF THE PREFERRED EMBODIMENTS

Figure 1:
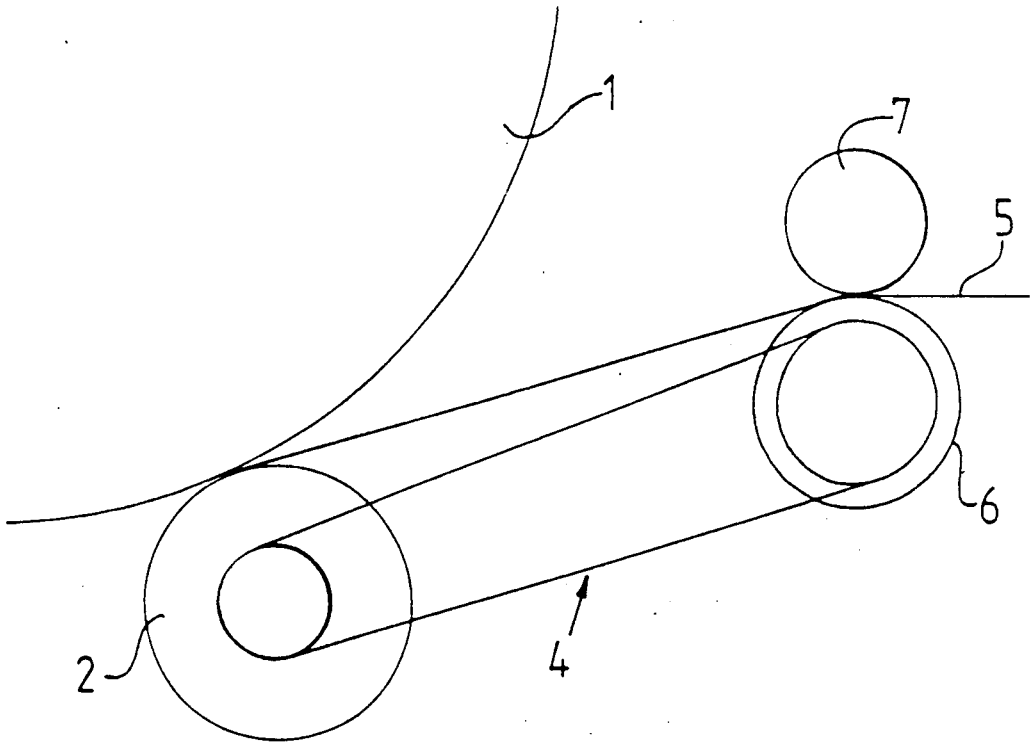
FIG. 1 depicts a schematic side elevation of the apparatus according to one embodiment of the invention for wrapping a stretched plastic film around the circumference of a cylindrical load.

According to FIG. 1, a cylindrical load 1 is packaged using a stretched film by rotating the load 1 about its axis by means of a drive roller 2 which supports and rotates it. Simultaneously, plastic film 5 from a feed roll (not shown in the figure) is led onto the surface of the rotating load 1. The plastic film 5 is stretched between the feed roll and the load 1 with the aid of belt transmission 4, in which the belt is coupled to the said drive roller 2 and to one 6 of the rollers of a separate brake roller pair 6, 7 located between the feed roll and the load 1. The other roller 7 of the brake roller pair presses the film against the roller 6 so that the film 5 cannot slip relative to the circumferential surface of the roller 6. Thus a plastic-film stretching distance is formed between the drive roller 2 and the brake roller pair 6, 7.

The belt transmission 4 of the rollers 2 and 6 is arranged in such a manner that the belt pulley which is in the roller 2 and concentric with it is smaller than the respective belt pulley of the roller 6. When the drive roller 2 is equal to or larger than the brake roller 6, it follows that the drive roller rotates at a higher circumferential speed than the brake roller 6. The effect of the above-mentioned radii on the film stretch ratio is in accordance with formula (2), provided that the film 5 does not slip relative to the rollers 2 and 6.

Figure 2:
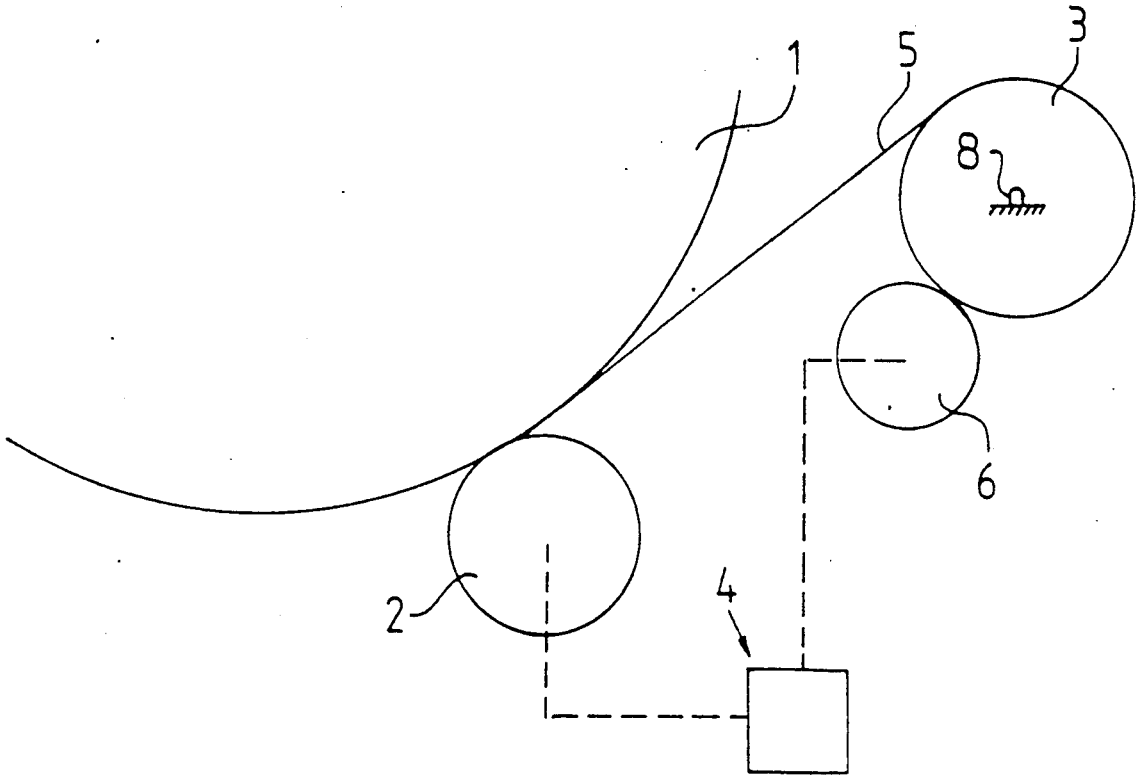
FIG. 2 depicts a schematic side elevation of the corresponding apparatus according to another embodiment of the invention.

According to FIG. 2, a cylindrical load 1 is packaged by rotating the load 1 about its axis by means of a drive roller 2 which supports and rotates it. Simultaneously, plastic film 5 is led to the surface of the rotating load 1 directly from the feed roll 3. The film is stretched between the feed roll 3 and the load 1 by using measuring and control means 4, which are connected to the drive roller 2 in order to measure and regulate the circumferential speed of the load 1, and to the brake roller 6 which is against the feed roll 3 in order to measure and regulate the circumferential speed of the brake roller and thereby of the feed roll. No slippage occurs between the brake roller 6 and the feed roll 3, and there is an eddy current brake mounted on the shaft of the brake roller 6.

The means 4 measures the circumferential speed of the load 1 and controls on the basis of that measurement the power by which the brake roller 6 brakes the feed roll 3. Simultaneously the circumferential speed of the feed roll 3 is measured and compared both to the controlled reference value and to the registered circumferential speed of the load. Feedback coupling to the drive roller 2 ensures that both the circumferential speeds of the load and the feed roll and their peripheral speed ratio remain at the desired levels. Thereby a stretching distance is formed between the drive roller 2 and the braked feed roll 3, within which distance the plastic film has the desired stretch ratio. If the measuring and control means 4 measure the angular speeds of the drive roller 2 and the brake roller 6, the stretch ratio of the film 5 is obtained from formula (1), provided that the film does not slip relative to the rollers 2 and 3.

The simple wrapping and stretching devices depicted in FIGS. 1 and 2 have the advantage that the stretching takes place immediately before the wrapping, in which case the stretched film immediately upon having been stretched will envelop the load being packaged. Thereby, there is produced not only a correct and uniform stretch ratio, but also a package tensioned with uniform elasticity. Since the stretch ratio is determined on the basis of the circumferential speed of the load, the apparatus can be used for packaging cylindrical loads of various cross sectional sizes and shapes (e.g. circle, ellipse, polygons with rounded angles).

We claim:

1. A method of packaging a cylindrical load by wrapping a stretched plastic film around the circumference of the load, comprising:

rotating said load and a plastic-film feed roll containing stretchable plastic film each about their respective axes to unwind the stretchable plastic film from the feed roll and to wrap the stretched plastic film around the circumference of the load at a wrapping point on the load, braking the plastic film to stretch the plastic between a braking point and the wrapping point, directly measuring the circumferential speed of the cylindrical load; and regulating the braking power which produces the stretching of the plastic film as the load is being wrapped on the basis of the measured circumferential speed of the load to form a packaged load.

2. A method according to claim 1, wherein the step of regulating the braking power further comprises regulating the braking power on the basis of the circumferential speed of the feed roll.

3. A method according to claim 1 wherein the step of braking comprises stretching the plastic film using a brake roller fitted against the plastic film feed roll.

4. An apparatus of packing a cylindrical load by wrapping a stretched plastic film around the circumference of the load, comprising:

load supporting and rotating means for supporting the load to be packaged and for rotating the load about its axis, a film feed roll having a roll of stretchable plastic film, bearing means for mounting a stretchable-film feed roll, braking means for braking, between the feed roll, and the load, the stretchable plastic film as the film is unwound from the feed roll and wound around the load, and measuring and regulating means for directly measuring the circumferential speed of the load and for regulating the braking power of the braking means in response to the to form a packaged load circumferential speed.

5. An apparatus according to claim 4, wherein the measuring and regulating means is connected to the load supporting and rotating means.

6. An apparatus according to claim 4 further comprising measuring and control means additionally connected to the braking means, for controlling the braking force in response to the circumferential speed.

7. An apparatus according to claim 5, wherein the braking means comprises a roller pair between the film feed roll and the load, the roller pair forming a compression point between its rollers and wherein one of the rollers is operationally connected to the load supporting and rotating means in such a manner that the said one roller rotates at a circumferential speed slower than the other roller, and wherein the other roller supports the load.

8. An apparatus according to claim 7, wherein the said one roller and the other roller are mechanically coupled to each other at a predetermined or regulatable transmission ratio.

9. An apparatus according to claim 5, wherein the load supporting and rotating means rotates the load about its axis.

* * * * *